US006367111B1

(12) United States Patent
Chen

(10) Patent No.: US 6,367,111 B1
(45) Date of Patent: Apr. 9, 2002

(54) HAIRBRUSH

(76) Inventor: Kuo-Chin Chen, 2-1 Fl., No. 18, Alley 47, Lane 208, Jui An Street, Ta An District, Taipei (TW)

( * ) Notice: Subject to any disclaimer, the term of this patent is extended or adjusted under 35 U.S.C. 154(b) by 0 days.

(21) Appl. No.: 09/510,479

(22) Filed: Feb. 23, 2000

(51) Int. Cl.[7] ..... A46B 7/00

(52) U.S. Cl. ..... 15/160; 15/185

(58) Field of Search ..... 15/159.1, 160, 15/185, 184

(56) References Cited

U.S. PATENT DOCUMENTS 1,728,712 A * 9/1929 Aberle

* cited by examiner

*Primary Examiner*—Randall E. Chin
(74) *Attorney, Agent, or Firm*—Pro-Techtor International Services

(57) ABSTRACT

A hairbrush formed from two pivotally connected bristle holders is provided. A spring is disposed between the two bristle holders for the bristle holders to easily open or close relative to each other. When the hairbrush is used in styling hairdo, hairs may be held in place between the two bristle holders without flying disorderly under the hot air of a hair drier. A user's thumb, which is usually extended to hold the hairs in place during styling hairdo, could be protected from burning by the hot air of the hair drier.

1 Claim, 4 Drawing Sheets

HAIRBRUSH

BACKGROUND OF THE INVENTION

The present invention relates to a hairbrush, and more particularly to a hairbrush that includes two bristle holders to hold hairs in place during styling hairdo and protect a user's hand from burning by hot air of a hair drier.

A hairbrush is a very common article in our daily life to help people set their hairs and make them look tidy and spirited.

A conventional hairbrush usually includes multiple bristle strips provided at one side thereof. A user may easily brush the bristle strips through the hairs to make the latter neat. When the user uses the hairbrush along with a hair drier to style the hairs, as shown in FIG. 1, he or she would extend the hairbrush below the hairs, so that the hairs fall among the bristle strips. Meanwhile, the user would naturally extend a thumb of the hand holding the hairbrush in an attempt to hold the hairs in place without frying disorderly under the hot air of the hair drier. The user's thumb is therefore possibly burned by the hot air of the hair drier during styling hairdo for a prolonged time.

It is therefore desirable to develop an improved hairbrush that could conveniently hold the hairs in place without the risk of burning the user's thumb.

SUMMARY OF THE INVENTION

A primary object of the present invention is to provide a hairbrush that includes two pivotally connected bristle holders for conveniently holding hairs in place between them, so that the hairs would not fly disorderly under the hot air of a hair drier.

Another object of the present invention is to provide a hairbrush that includes two pivotally connected bristle holders to hold hairs between them, so that a user of the hairbrush need not to extend a thumb for holding the hairs and the thumb could be protected against burning by the hot air of the hair drier.

To achieve the above and other objects, the hairbrush according to the present invention mainly includes two bristle holders, a pivot pin and a spring. The two bristle holders are provided at inner surfaces with multiple bristle strips. An end of the two bristle holders opposite the bristle strips are so shaped that they could be pivotally connected to each other with the pivotal pin. The spring is disposed between the two bristle holders, so that they could be easily sprung open or elastically pressed together relative to each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
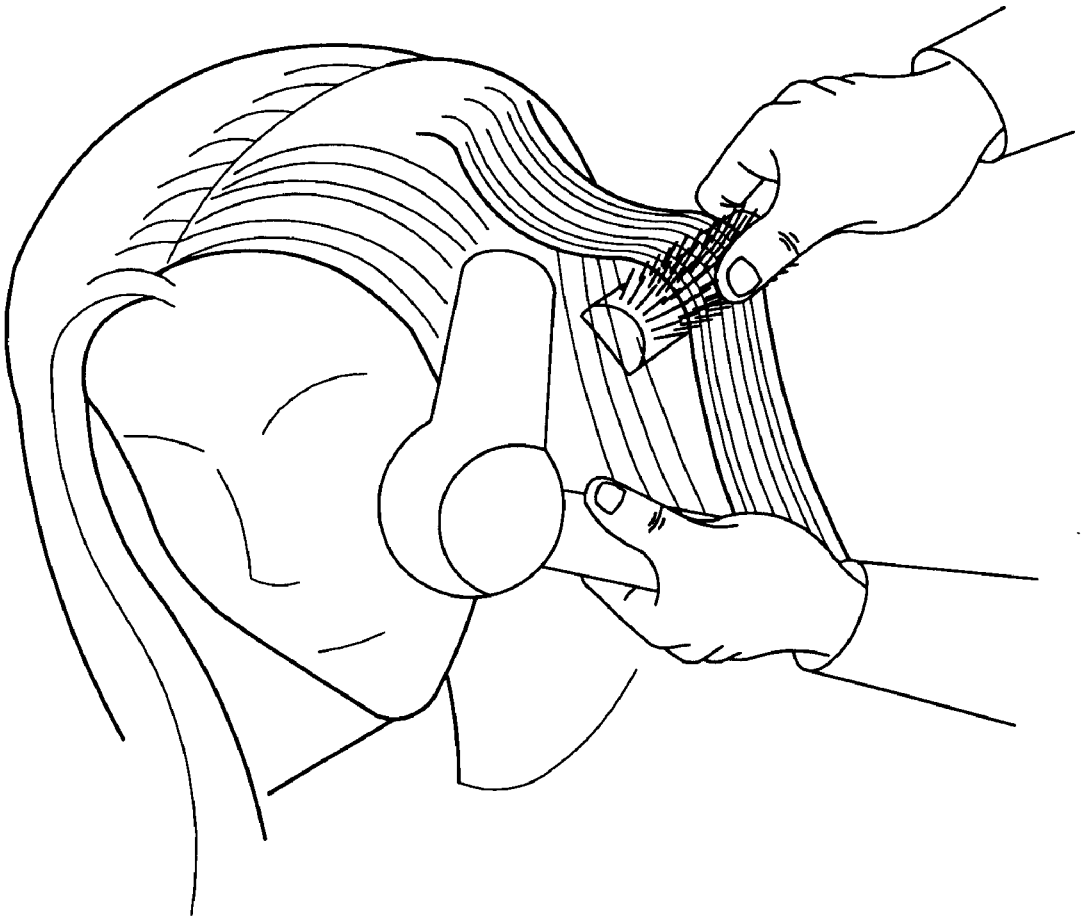
(PRIOR ART) Fig.1
FIG. 1 shows the manner of using a conventional hairbrush in styling hairdo.
Figure 2:
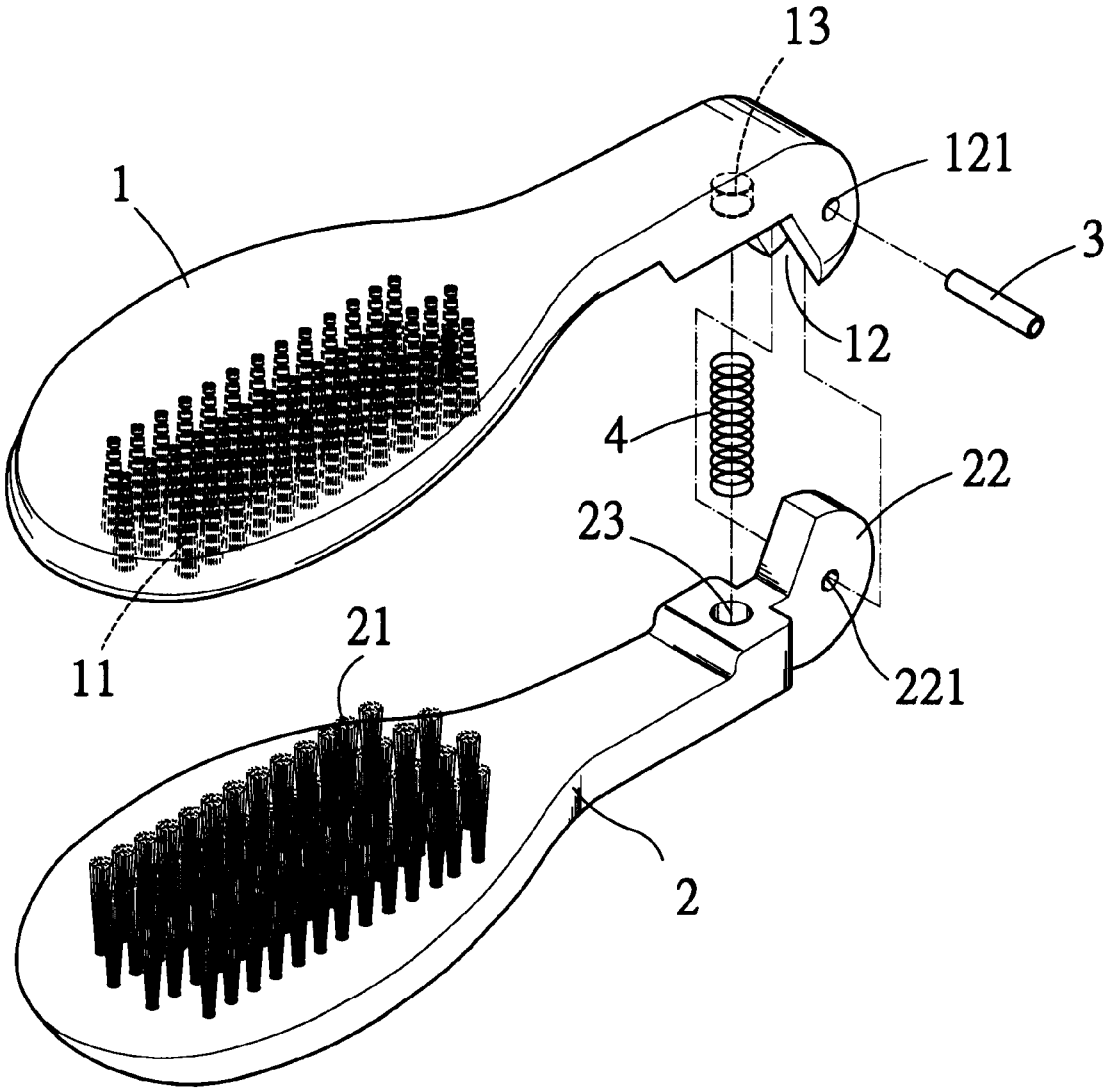
FIG. 2 is an exploded perspective of a hairbrush according to the present invention.

Please refer to FIG. 2 that is an exploded perspective of a hairbrush according to the present invention. As shown, the hairbrush of the present invention mainly includes an upper bristle holder 1 and a lower bristle holder 2.

The upper bristle holder 1 is provided at an inner surface at predetermined positions with, for example, three bristle strips 11. A rear portion of the upper bristle holder 1 is narrowed to provide a handle. An outer end of the handle portion of the upper bristle holder 1 defines a slot 12. Two sidewalls of the slot 12 are correspondingly provided with a hole 121 each. And, a first receiving hole 13 of a suitable depth is formed on the inner surface of the handle portion at some distance in front of the slot 12.

The lower bristle holder 2 is provided at an inner surface at predetermined positions with, for example, four bristle strips 21. A rear portion of the lower bristle holder 2 is narrowed corresponding to the upper bristle holder 1 to provide a handle. An outer end of the handle portion of the lower bristle holder 2 forms a pivot head 22 for movably fitting in the slot 12. The pivot head 22 is provided at a predetermined point with a through hole 221 corresponding to the holes 121 on the sidewalls of the slot 12 of the upper bristle holder 1. A second receiving hole 23 of a suitable depth is formed on the inner surface of the lower bristle holder 2 at some distance in front of the pivot head 22 corresponding to the first receiving hole 13.

When the pivotal head 22 of the lower bristle holders 2 is fitted in the slot 12 of the upper bristle holder 1 with the through hole 221 aligned with the two holes 121, a pivotal pin 3 may be extended through the holes 121 and 221 to pivotally connect the upper and the lower bristle holders 1, 2 to each other at the handle portions, so that the upper and the lower bristle holders 1, 2 could be pivotally turned relative to each other between an open and a closed positions.

A spring 4 is disposed between the upper and the lower bristle holders 1, 2 with two ends thereof received in the first and the second receiving holes 13, 23. The spring 4 provides sufficient tension force to either push apart the upper and the lower bristle holders 1, 2 from the closed position or allow the upper and the lower bristle holders 1, 2 to fully close to each other from the open position.

Figure 3:
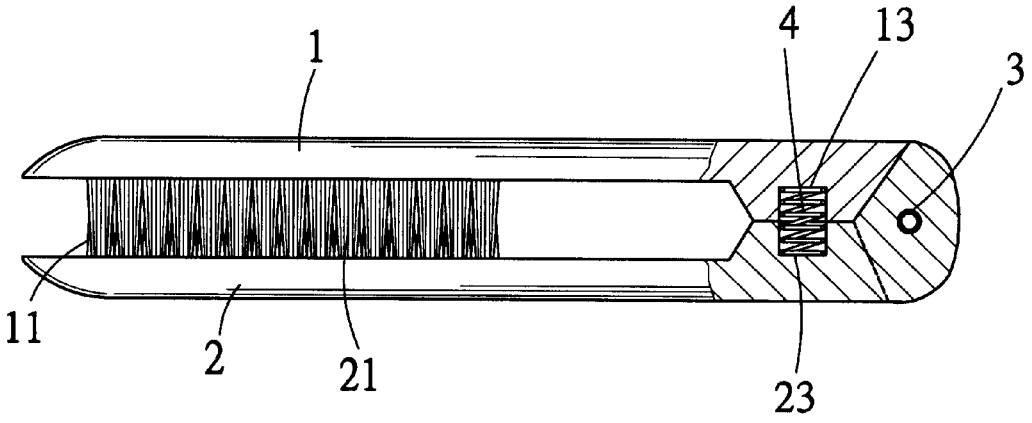
FIG. 3 is a side view of the hairbrush of the present invention in an assembled state.
Figure 4:
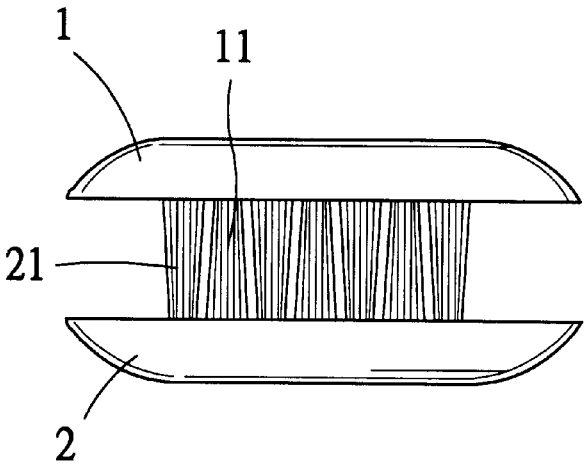
FIG. 4 is a front view of the hairbrush of FIG. 3.

FIGS. 3 and 4 are side and front views, respectively, of the hairbrush of the present invention with the upper and the lower bristle holders 1, 2 pivotally connected to each other and in a closed position. It can be clearly seen from FIG. 4 that the bristle strips 11 and the bristle strips 21 on the upper and the lower bristle holders 1 and 2, respectively, are so arranged that they are in a staggered pattern when the upper and the lower bristle holders 1, 2 are closed to each other.

Figure 5:
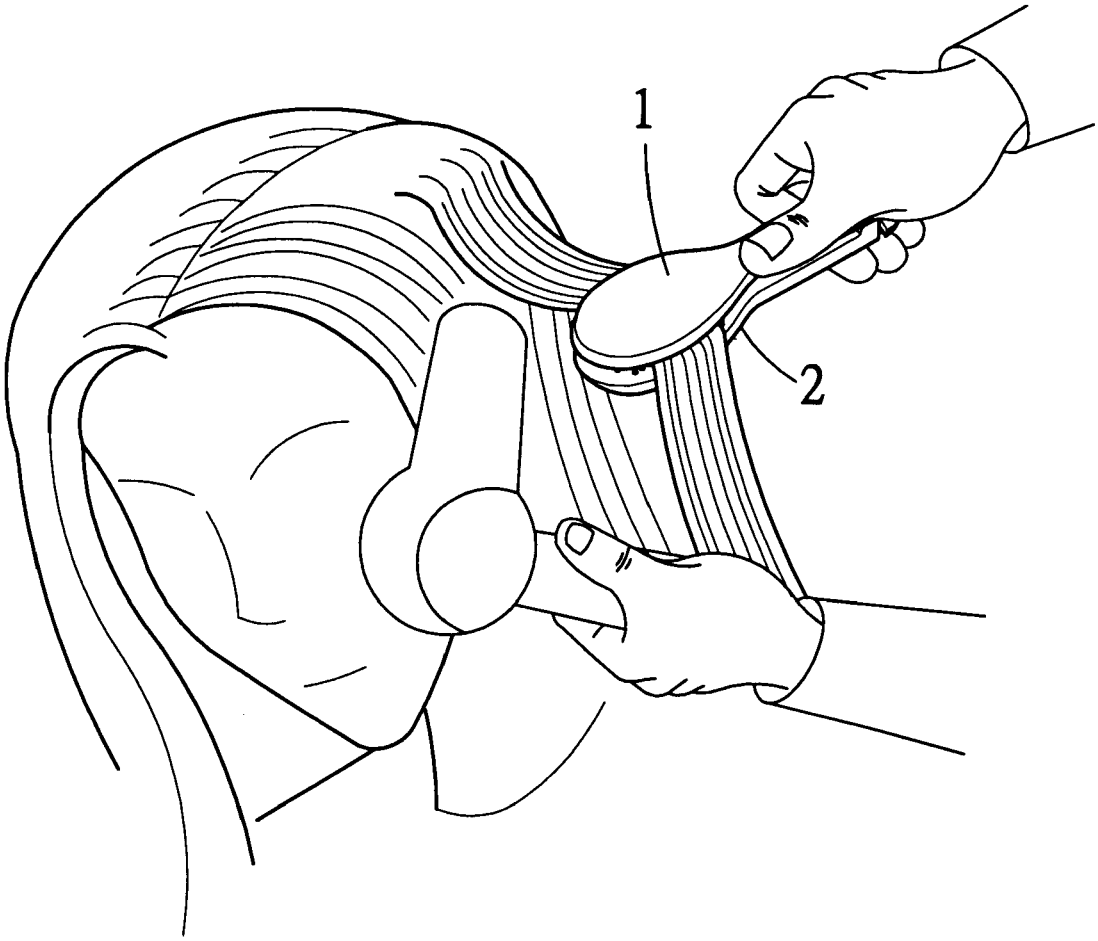
FIG. 5 shows the manner of using the hairbrush of the present invention in styling hairdo.

FIG. 5 shows the manner of using the hairbrush of the present invention in styling hairdo. First, the upper bristle holder 1 is allowed to pivotally spring open under the tension force of the spring 4. Then, extend the lower bristle holder 2 below the hairs to be taken care just in the same manner as using a common hairbrush, so that the lower bristle strips 21 catch the hairs. At this point, apply only a minor force on the upper bristle holder 1 to close the same onto the lower bristle holder 2 and hold the hairs in place between the staggered upper and lower bristle strips 11 and 21. When a user turns on a hair drier to set the hairs held in place by the hairbrush of the present invention, the hairs would not fly disorderly under the hot air from the hair drier. Moreover, since the hairs are held in place between the upper and the lower bristle holders 1, 2, the user need not to risk his or her thumb holding the hairs in place and being hurt by the hot air from the hair drier during hair styling for a prolonged time.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A hairbrush comprising a first bristle holder, a second bristle holder, a pivotal pin, and a spring;

said first bristle holder being provided at an inner surface at predetermined positions with multiple first bristle strips, at an end opposite to said first bristle strips with a slot, two sidewalls of said slot being correspondingly provided with a hole in each, and at a position on said inner surface some distance in front of said slot with a first receiving hole;

said second bristle holder being provided at an inner surface at predetermined positions with multiple second bristle strips, at an end opposite to said second bristle strips with a pivotal head that is sized for movably fitting in said slot of said first bristle holder and has a through hole corresponding to said holes on the sidewalls of said slot of said first bristle holder, and at a position on said inner surface some distance in front of said pivotal head with a second receiving hole corresponding to said first receiving hole on said first bristle holder;

said first and said second bristle strips being so arranged on said first and second bristle holders that they are staggered arranged when said first and said second bristle holders are closed to each other;

said pivotal pin being extended through said holes on said slot and said pivotal head to pivotally connect said first and said second bristle holders to each other, so that said first and said second bristle holders could be pivotally turned relative to each other between an open and a closed positions; and said spring being disposed between said first and said second bristle holders with two ends thereof received in said first and said second receiving holes to provide a tension force to either push apart said first and said second bristle holders from said closed position or allow said first and said second bristle holders to fully close to each other from said open position;

whereby when said first and said second bristle holders are closed to hold hairs in place between said first and said second bristle strips during styling hairdo, the hairs are prevented from flying disorderly and the user's thumb is protected against burning due to the hot air of a hair drier blown toward the hairs.

* * * * *